US005112429A

United States Patent [19]

Costas

[11] Patent Number: 5,112,429

[45] Date of Patent: May 12, 1992

[54] LABELING APPARATUS

[76] Inventor: Dan N. Costas, 1006 Gray Fox Cir., Pleasanton, Calif. 94566

[21] Appl. No.: 570,161

[22] Filed: Aug. 17, 1990

[51] Int. Cl.[5] ..... B44C 1/00

[52] U.S. Cl. ..... 156/542; 156/361; 156/540; 221/71

[58] Field of Search ..... 156/541, 542, 361, 364, 156/362, 540, 363; 221/71, 73, 70, 72, 75

[56] References Cited

U.S. PATENT DOCUMENTS

| | | | |
|---|---|---|---|
| Re. 31,726 | 11/1984 | Sato | 156/542 |
| 95,689 | 10/1869 | Howard | 118/419 |
| 2,256,227 | 9/1941 | Zaccheo | 118/419 |
| 2,832,453 | 4/1958 | Anderson | 221/188 |
| 4,792,057 | 12/1988 | Mizer et al. | 221/270 |

*Primary Examiner*—David A. Simmons
*Assistant Examiner*—Robert Barker
*Attorney, Agent, or Firm*—Limbach & Limbach

[57] ABSTRACT

A labeling apparatus is presented. The apparatus has a pair of stationary rollers. There is a gap between the rollers. An idler wheel is positioned opposite the stationary rollers to engage the object and hold it against the rollers. A floating pin is positioned between the rollers and the object. The pin diameter is larger than the roller gap. A continuous web of labels is threaded through the gap and around the pin. When the web is advanced, the tension forces the web and pin against the rollers causing the rollers to rotate in the opposite direction, thus driving the engaged object forward. As the web advances, the label does not follow the diameter of the pin and is separated from the web and applied to the object. An object supply hopper has separating means for providing individual objects to the rollers. The entire apparatus is angled relative to the horizontal plane. The hopper is oblique to the plane of the object.

17 Claims, 5 Drawing Sheets

LABELING APPARATUS

BACKGROUND

1. Field of the Invention

This invention relates to applying labels to objects.

2. Background of the Invention

The art of product labeling is well known. In one type of labeling system, pressure sensitive labels having adhesive backing are spaced end-to-end on a continuous web or roll. The web is threaded through a labeling machine, at one point being guided around a sharp edge, thus causing the label to separate from the web and allowing it to be applied to the product. This method can be seen in U.S. Pat. No. 4,869,775 (FIG. 4), U.S. Pat. No. 4,711,687 (FIG. 8), U.S. Pat. No. 4,235,661 (FIG. 4), U.S. Pat. No. 4,194,941 (FIGS. 2–4), and U.S. Pat. No. 3,321,105 (FIG. 4).

A major problem with these conventional techniques is that stretching the web across a sharp edge leads to breakage of the web. This interrupts production, fouls equipment, and raises costs.

Another problem is that registration of labels varies greatly, leading to unacceptable tolerances.

A third problem is that equipment often jams because the object infeed cannot adequately separate an individual object from a supply stack.

A fourth problem is that the object to be labeled has to move at the same speed as the label being applied. This requires separate means for synchronizing the speeds of the object and the labeler.

SUMMARY OF THE INVENTION

An apparatus for applying a label from a continuous web to an object traveling forward along an object path is disclosed. A pair of stationary rollers are sequentially aligned along the object path to engage the object and transport it forward. The rollers have a gap between them. An idler wheel is positioned opposite the stationary rollers along the object path to engage and hold the object against the stationary rollers as the object travels along the object path. A floating pin is positioned between the rollers and the object path. The floating pin has a diameter larger than that of the gap between the stationary rollers. The web is pulled under tension through the gap, around the floating pin, and back through the gap, such that the web and pin are forced against the rollers, causing them to rotate and drive the engaged object forward along the object path. The label is separated from the web and transferred to the object as the web travels around the floating pin.

In the preferred embodiment, the entire apparatus is angled relative to the horizontal plane. Additionally, a supply of objects is received in an obliquely positioned holding means, individual objects being separated therefrom and presented to transporting means, which carries the objects to the point where the object is engaged by the stationary rollers.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE INVENTION

Figure 1:
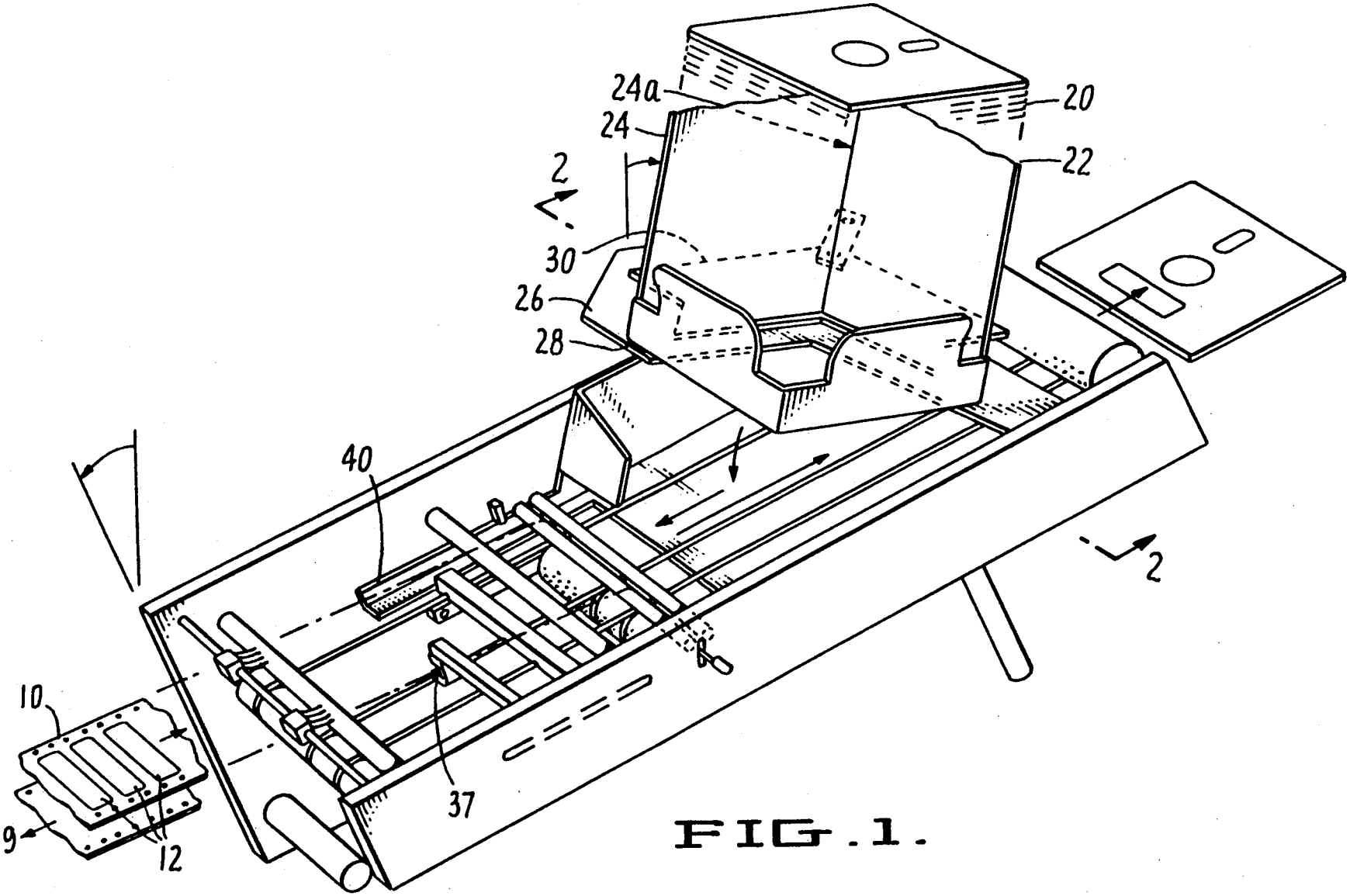
FIG. 1 is a perspective view of the labeler of the present invention.
Figure 3:
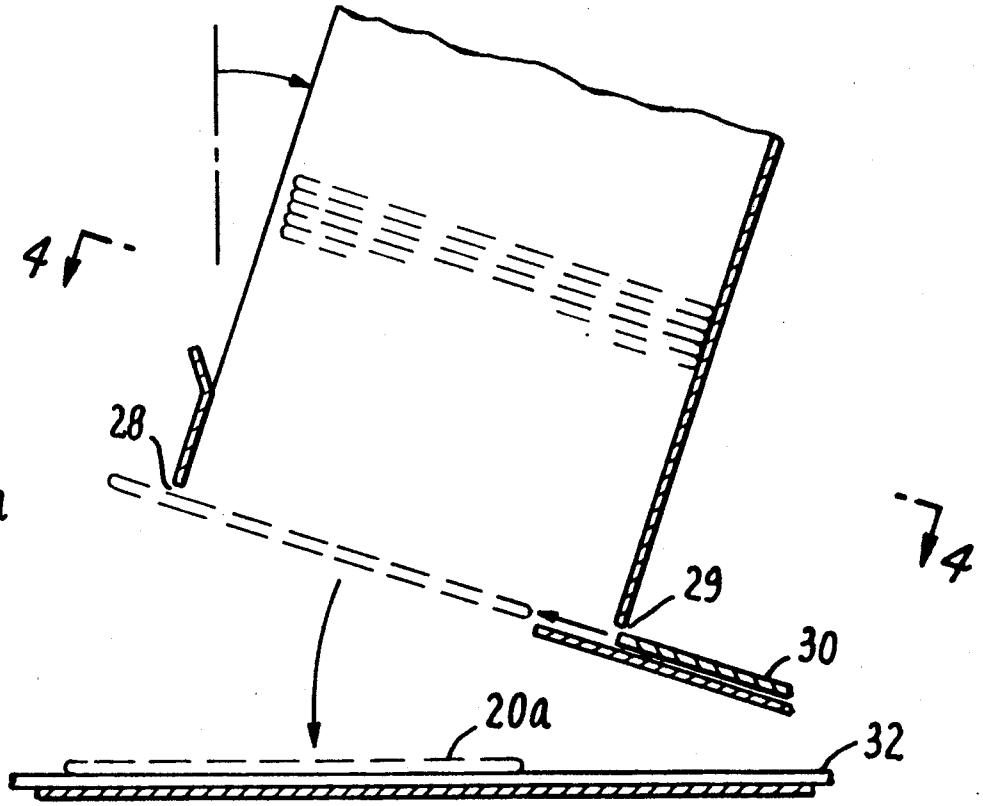
FIG. 3 is a side plan view of one aspect of the present invention (the separator) taken along line 3—3 of FIG. 2.
Figure 2:
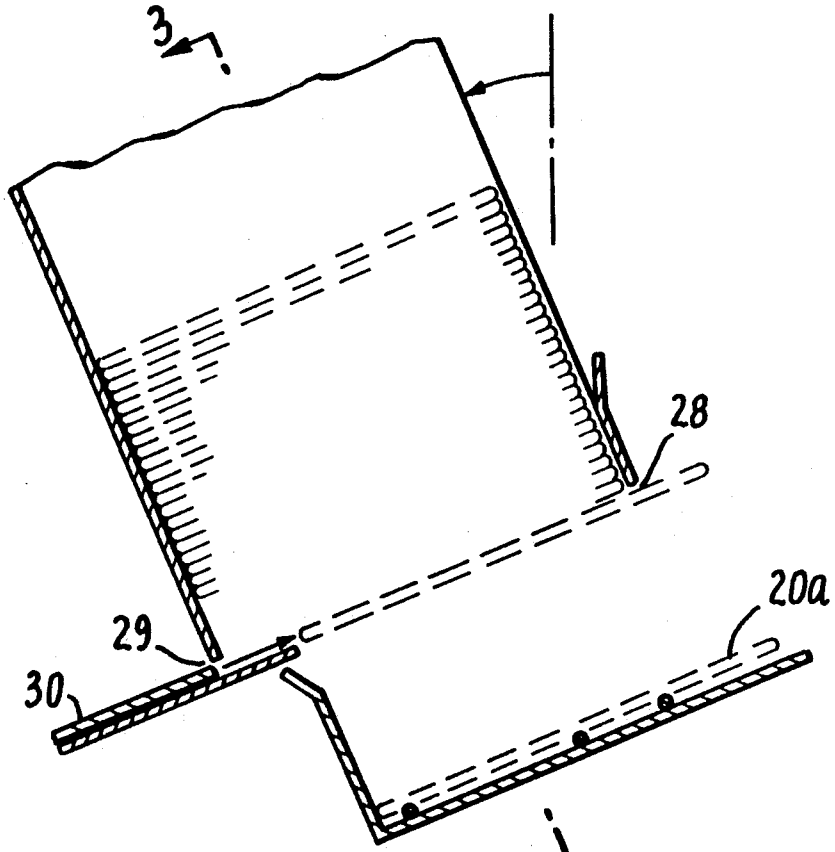
FIG. 2 is a side plan view of one aspect of the present invention (the separator) taken along line 2—2 of FIG. 1.
Figure 4:
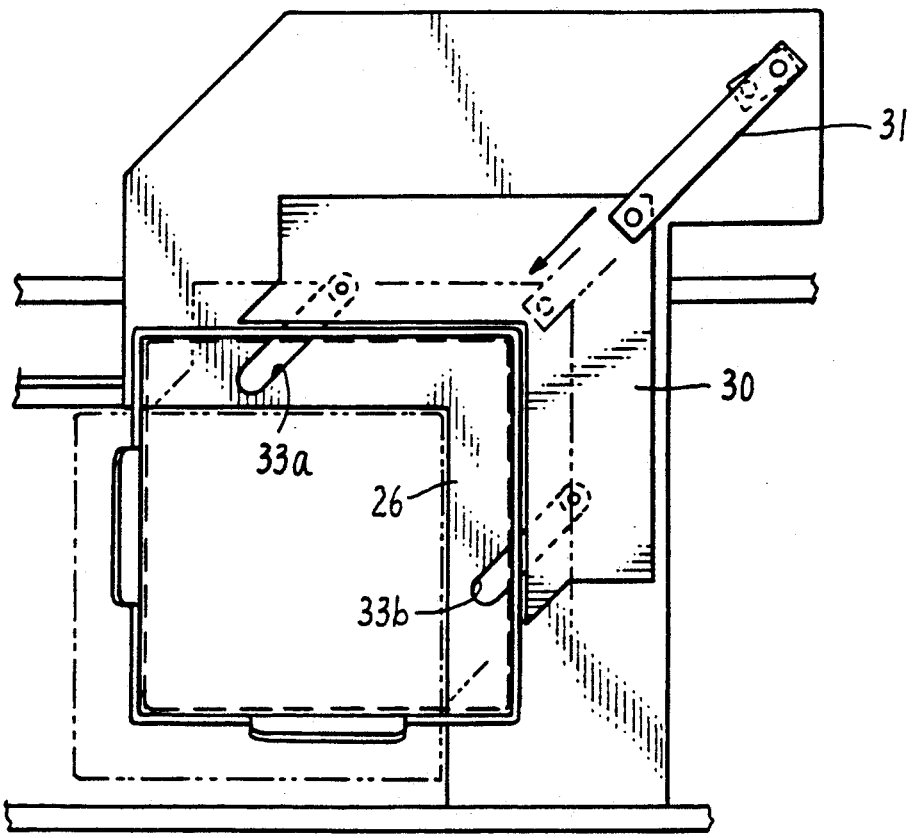
FIG. 4 is a bottom plan view of one aspect of the present invention (the separator) taken along line 4—4 of FIG. 3.
Figure 5:
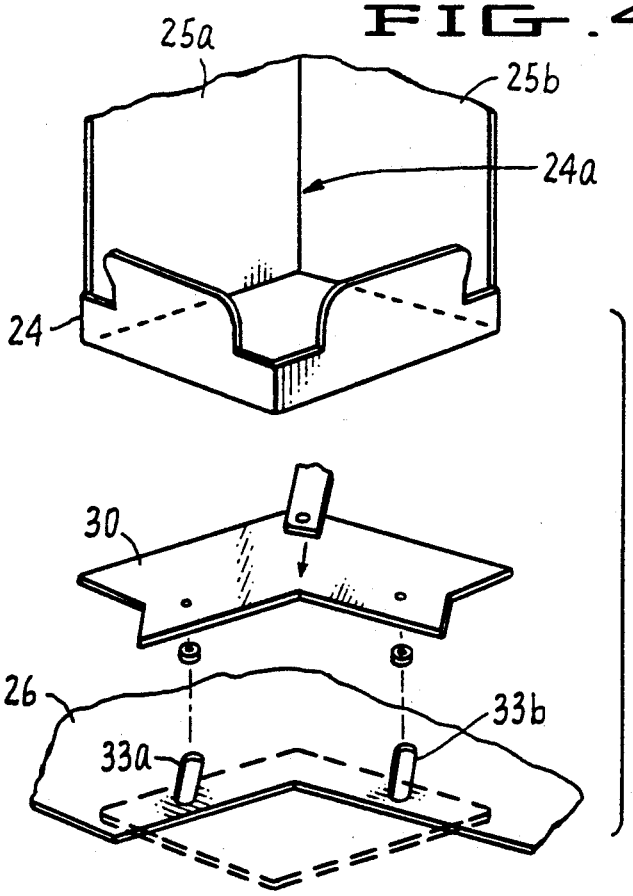
FIG. 5 is an exploded perspective view of one aspect of the invention (the separator).
Figure 6:
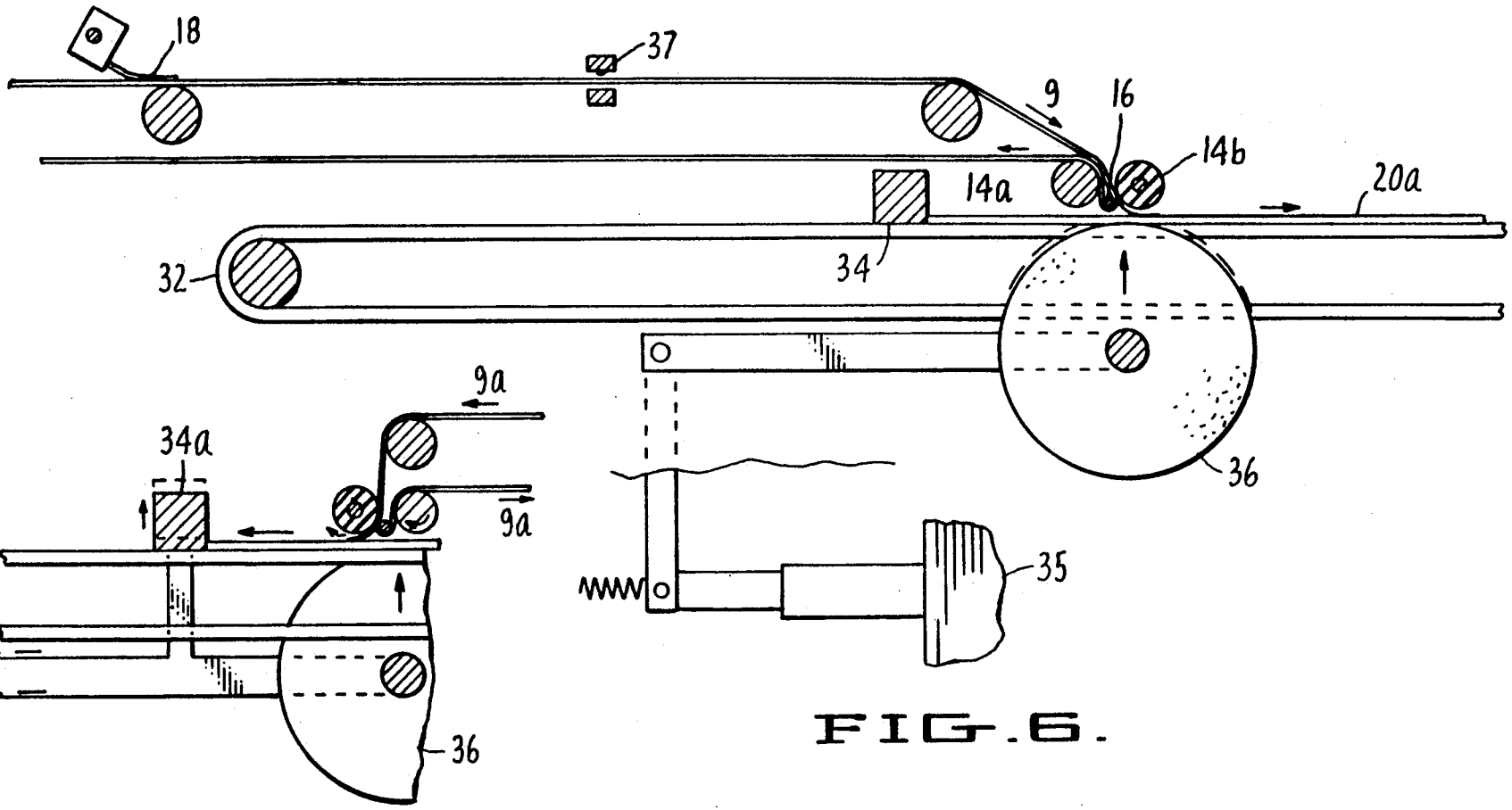
FIG. 6 is a side plan view of the labeling operation according to the present invention.

Referring now to FIGS. 1 and 6, a continuous web 10 having pressure sensitive labels 12 adhered thereto is threaded between stationary rollers **14*a* and 14*b* and around pin 16. The pin 16 diameter is larger than the gap between the rollers 14*a* and 14*b*. Pin 16 is removable for ease of threading and floats up and down in elongated slot 17 due to tension from the web 10. A takeup reel (not pictured) provides tension by pulling the web 10 through the pin and roller assembly in the direction shown by arrow 9. Additional tension is provided on the web infeed by a tensioning device, such as brush 18. As the web 10 is pulled, the tension caused thereby forces the pin 16 between the rollers 14*a* and 14*b*** and the web contacts the rollers causing them to rotate.

Referring now to FIGS. 1–5, a supply of diskettes 20 to be labeled are stacked in the separator 22. The separator 22 is inclined obliquely relative to conveyor 32 (see FIG. 3), and the entire apparatus is inclined relative to the horizontal plane, preferably at an angle greater than 18 degrees. For standard 5.25 inch diskettes, an angle of 18 degrees is sufficient. With heavier objects, a steeper inclination is recommended. The separator 22 has a 5.25 inch square hopper 24 for receiving standard 5.25 inch floppy diskettes. It should be noted, however, that the inclination of the separator 22 and the entire apparatus makes only the existence of the first pair of walls **25*a*, 25*b* necessary, since gravity will force any object with a right angle edge, such as a floppy disk, into corner 24*a*. The hopper 24 attaches to an L-shaped bottom plate 26, which supports the weight of the diskettes 20, which are urged by gravity into corner 24*a*. Between the hopper 24 and bottom plate 26 are two openings 28, 29. Opening 28 is slightly larger than the thickness of a single diskette, while opening 29** is slightly smaller than the thickness of a typical diskette.

The labeling cycle begins with the action of reciprocating blade 30. The blade 30 has thickness which is equal or smaller than the thinnest diskette. For each cycle, the blade motor (not shown) drives arm 31 which is connected to blade 30 to reciprocate along slots 33*a*, 33*b*. The blade 30 emerges from opening 29 in corner 24*a* and pushes a single diskette 20*a* through opening 28 and off of bottom plate 26 onto conveyor 32.

Referring now to FIGS. 1 and 6, the diskette 20*a* travels on conveyor 32 until it hits stop 34, where a disk present signal is generated. The disk present signal activates solenoid 35, which urges idler wheel 36 upward to engage the diskette 20*a* against the rollers 14*a* and 14*b*. The disk present signal also advances the web 10 forward for one label, as determined by conventional detecting means 37. As the web advances, two events occur simultaneously: first, the web tension causes the rollers 14*a* and 14*b* to rotate, thus transporting diskette 20*a* back along conveyor 22 at the same speed as the web; second, label 12*a* does not follow the web 10 around pin 16, but rather is peeled smoothly off the web to contact the moving diskette 20*a* and attached thereto. This can be done in one smooth motion because the web speed is what dictates the driven speed of the diskette 20*a*, thus, the label application will always be uniform, requiring no synchronization of conveyor speed to labeler speed.

Figure 7:
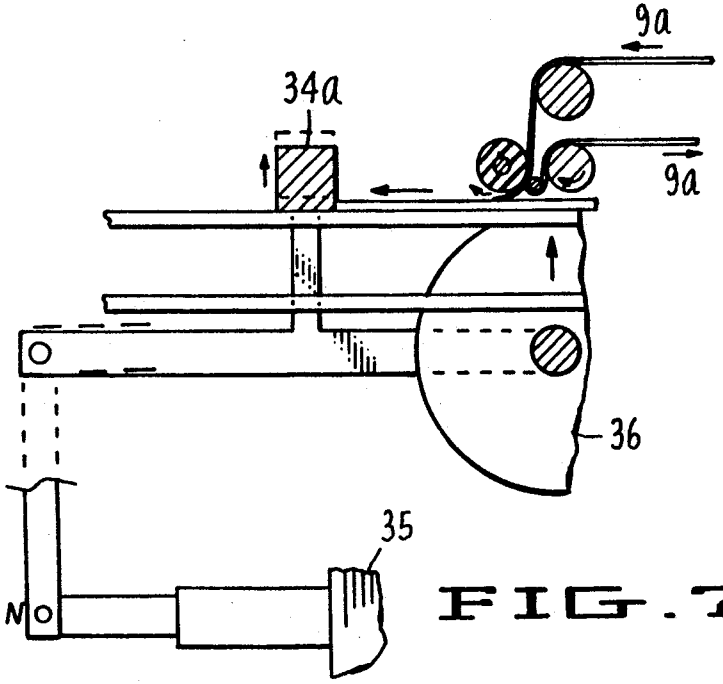
FIG. 7 is a side plan view of an alternative embodiment of the labeling operation according to the present invention.

Referring now to the alternative embodiment of FIG. 7, the stop 34*a* can be coupled to the solenoid 35 and idler wheel 36, and the web 10 oriented in the opposite direction (see arrow 9*a*), such that upon hitting the stop 34*a* and initiating the disk present signal, the stop will be lifted in coordination with the idler wheel 36 such that the diskette 20*a* can be transported forward by the labeling cycle, rather than backward as in the previous embodiment.

Label registration in both the longitudinal and latitudinal directions can be accurately obtained by the present invention. The inclination of the entire apparatus at an angle relative to the horizontal plane, as described above, enables accurate latitudinal registration relative to wall 40 of conveyor 22, since diskette 20*a* is gravity forced against the wall. By changing the position of the web 10 or the wall 40, the latitudinal position of the label may be altered. Likewise, the use of stop 34 (or 34*a*) allows accurate longitudinal registration relative to the position of the stop. By changing the position of the stop 34, easily accomplished through a locking adjustment slot 37, the longitudinal position of the label may be altered.

Figure 8:
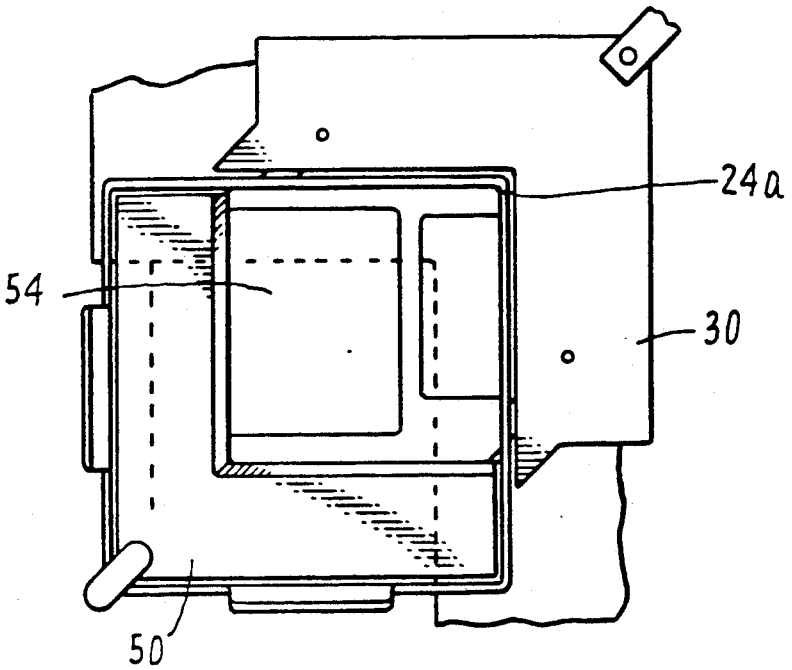
FIG. 8 is a bottom plan view of one aspect of the present invention (the separator) shown for use with an adaptor.
Figure 9:
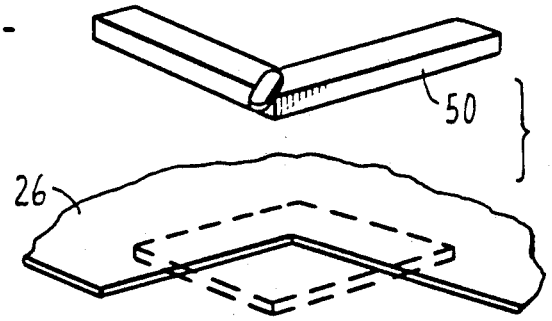
FIG. 9 is a perspective view of the adaptor shown in FIG. 8.
Figure 10:
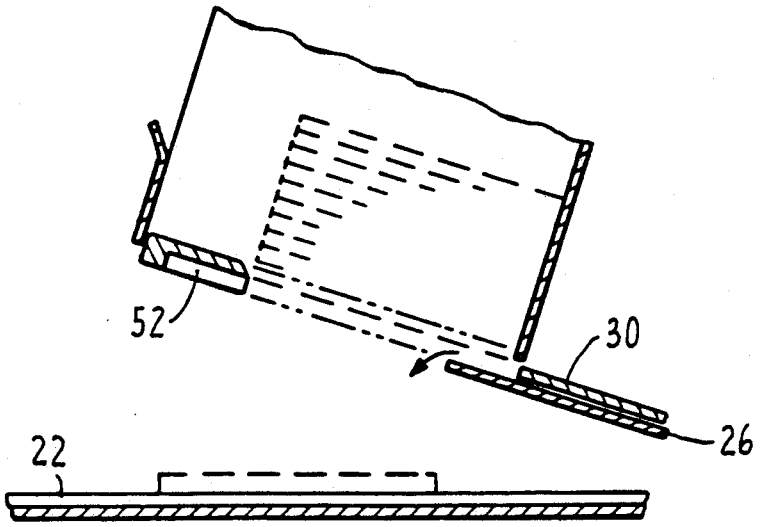
FIG. 10 is a side plan view of one aspect of the present invention (the separator) shown for use with an adaptor.

Referring now to FIGS. 8–10, the separator 22 can be adapted to hold different sized objects, such as 3.5 inch diskette 54, so long as the objects have at least one square corner which rests at corner 24*a*. An adaptor 50 is placed in the separator opposite the corner 24*a*, so as to ensure that the smaller diskettes are forced against corner 24*a*. The bottom of adaptor 50 has notch 52 which allows the smaller diskette to be pushed by blade 30 off of plate 26 and onto conveyor 22.

It should be understood that the invention is not intended to be limited by the specifics of the above-described embodiment. For example, conceivably any object can be labeled by the present invention by modifying the roller and idler arrangement. The ability to obtain accurate registration is not limited to applying labels, but may include applying any type of marking to any type of object, or scanning the object in some precise location. The separator can function to separate any object which has at least one right angle edge. The scope of the invention is defined by the accompanying claims.

I claim:

1. An apparatus for applying a label from a continuous web to an object comprising:, a. a pair of fixed rotatable rollers sequentially aligned to engage and transport the object, the rollers having a gap therebetween;

b. at least one movable idler wheel positioned opposite the stationary rollers to engage and hold the object against the stationary rollers; and c. a floating pin having a diameter larger than that of the gap between the stationary rollers and movably positioned between the rollers and the object;

whereby the web is threaded through the gap, around the floating pin, and back through the gap, such that upon pulling the web, the web and pin are forced against the rollers, causing them to rotate and transport the engaged object in a first direction at the same speed as the web, and whereby the label is separated from the web as the web is pulled around the floating pin, the label being simultaneously transferred to the object as the object is transported by the rollers in the first direction.

2. The apparatus of claim 1, further comprising means for urging the idler wheel against the object.

3. The apparatus of claim 1, wherein a plane containing the apparatus is angled relative to the horizontal plane.

4. The apparatus of claim 3, wherein the angle between the object plane and the horizontal plane is greater than eighteen degrees.

5. The apparatus of claim 3, further comprising:

a. means for transporting the object to and from the fixed rotatable rollers.

6. The apparatus of claim 5, further comprising:

a. means for holding a plurality of objects to be labeled; and b. means for separating an individual object from the holding means and supplying the object to the transporting means.

7. The apparatus of claim 6, wherein the holding means comprises:

a. a structure having a first pair of walls connected together at right angles; and b. a bottom plate attached at one end of the structure to support the objects; and c. a first opening between the bottom plate and first pair of walls sufficient to pass the separating means through.

8. The apparatus of claim 7, wherein the holding means is oblique to the transporting means such that objects having at least one square edge are forced by gravity to rest into a first corner between the first pair of walls.

9. The apparatus of claim 8, wherein the holding means further comprise:

a. a second pair of walls connected at right angles to each other and at right angles to the first pair of walls; and b. a second opening between the bottom plate and the second walls sufficient to pass an individual object therethrough;

10. The apparatus of claim 9, wherein the second opening is slightly larger than the thickness of an individual object.

11. The apparatus of claim 8, wherein the separating means comprises:

a. a blade having a thickness which is thinner than the smallest object to be separated, the blade being slidably attached to move in the first opening parallel to the bottom plate so a to push an individual object off the bottom plate.

12. The apparatus of claim 11, wherein the bottom plate is generally L-shaped and positioned to provide support ledge for the objects corresponding to the region between the first pair of walls.

13. The apparatus of claim 11, further comprising an L-shaped adaptor which fits within the structure directly opposite the first corner to urge smaller objects to rest against the first corner.

14. An apparatus for applying a label from a continuous web to a computer diskette, comprising:

a. a pair of fixed rotatable rollers sequentially aligned to engage and transport the diskette, the rollers having a slight gap therebetween;

b. a movable idler wheel, positioned opposite the fixed rotatable rollers to engage and hold the diskette against the fixed rotatable rollers;

c. means for urging the idler wheel against the diskette;

d. a floating pin positioned between the rollers and the diskette, the pin having a diameter larger than that of the gap between the rollers, wherein the web is threaded through the gap, around the pin, and back through the gap;

e. means for conveying the diskette to the rollers;

f. means for separating the diskette from a stacked supply of diskettes and delivering the diskette to the conveying means;

g. means for detecting when the diskette is in the proper labeling position; and h. means for advancing the web for a single label; whereby a plane containing the apparatus is angled relative to the horizontal plane, and whereby the separating means are oblique to the conveying means, and whereby upon detection of the proper labeling position, the idler wheel is urged against the diskette to hold it against the rollers and the web is advanced, the tension on the web forcing the web and pin against the rollers, causing the rollers to rotate and drive the diskette at the same speed as the web, and whereby the label separates from the web as the web travels around the pin, and whereby the diskette smoothly picks the separating label off the web as the diskette is driven past the pin.

15. The apparatus of claim 14, wherein the angle between the object plane and the horizontal plane is greater than eighteen degrees.

16. The apparatus of claim 14, wherein the separating means comprises:

a. a structure having a first pair of walls connected together at right angles and a second pair of walls connected at right angles to each other and at right angles to the first pair of walls;

b. a bottom plate attached at one end of the structure to support the diskettes;

c. a first opening between the bottom plate and first pair of walls slightly thinner than an individual diskette;

d. a second opening between the bottom plate and the second walls slightly thicker than an individual diskette; and e. a blade slidably attached to move in the first opening parallel to the bottom plate so a to push an individual diskette off the bottom plate.

17. The apparatus of claim 16, wherein the bottom plate is generally L-shaped and positioned to provide a support ledge for the diskettes corresponding to the region between the first pair of walls.

* * * * *